US005494177A

United States Patent [19]

Todd, Jr.

[11] Patent Number: 5,494,177

[45] Date of Patent: Feb. 27, 1996

[54] DISPLAY RACK

[76] Inventor: Alvin E. Todd, Jr., 3360 Progress Hill Blvd., Pigeon Forge, Tenn. 37863

[21] Appl. No.: 116,690

[22] Filed: Sep. 3, 1993

Related U.S. Application Data

[63] Continuation-in-part of Ser. No. 922,150, Jul. 30, 1992, Pat. No. 5,242,054.

[51] Int. Cl.[6] ..... A47F 5/00

[52] U.S. Cl. ..... 211/163; 211/115

[58] Field of Search ..... 211/163, 58, 78, 211/95, 115

[56] References Cited

U.S. PATENT DOCUMENTS

| | | | |
|---|---|---|---|
| 889,517 | 6/1908 | Gerken | 211/115 X |
| 1,875,563 | 9/1932 | Cooke et al. . | |
| 2,868,386 | 1/1959 | Seyforth | 211/95 |
| 3,127,993 | 4/1964 | Phipps . | |
| 3,129,817 | 4/1964 | Rohdin . | |
| 3,184,059 | 5/1965 | Kaplan . | |
| 3,255,890 | 6/1966 | Gerber | 211/163 |
| 3,298,515 | 1/1967 | Watts, Jr. . | |
| 3,693,807 | 9/1972 | Larson . | |
| 3,761,289 | 9/1973 | Wolf . | |
| 3,861,528 | 1/1975 | Damuth . | |
| 3,861,578 | 1/1975 | McHan . | |
| 3,986,611 | 10/1976 | Dreher . | |
| 3,998,334 | 12/1976 | Smith | 211/163 X |
| 4,020,694 | 5/1977 | Mayhew . | |
| 4,170,294 | 10/1979 | Zelinski . | |
| 4,269,124 | 5/1981 | Rosenthal et al. | 211/163 X |
| 4,319,684 | 5/1982 | Backman et al. . | |
| 4,456,124 | 6/1984 | Kay et al. . | |
| 4,499,353 | 2/1985 | Shields . | |
| 4,567,981 | 2/1986 | Headon . | |
| 4,669,610 | 6/1987 | Lindsey et al. . | |
| 4,739,883 | 4/1988 | Mohs et al. . | |
| 4,779,734 | 10/1988 | Kydonieus . | |
| 4,804,984 | 2/1989 | Heuer et al. . | |
| 4,877,137 | 10/1989 | Govang et al. . | |
| 5,127,528 | 7/1992 | Cone | 211/163 X |
| 5,242,054 | 9/1993 | Todd . | |
| 5,397,005 | 3/1995 | Taccolini | 211/163 X |

FOREIGN PATENT DOCUMENTS

| | | |
|---|---|---|
| 270127 | 4/1969 | Germany . |

*Primary Examiner*—Robert W. Gibson, Jr.
*Attorney, Agent, or Firm*—Pitts & Brittian

[57] ABSTRACT

An improved display rack (10) which allows the use of a pivotable display unit (16) with existing display facilities such as existing shelving (54) or an existing suspended ceiling (62). The improved display rack (10) may be used to display such things as ceiling fan pulls, postcards, greeting cards, keychains, and comic books. The improved display rack (10) comprises a pivotable display unit (16), a lower supporting member (12), and an upper stabilizing member (14). The lower supporting member (12) is attached, at one end, to a bottom portion of the pivotable display unit (16) and, at the other end, engages either a supporting surface, such as the floor, or is attached to the existing shelving (54). The upper stabilizing member (14) is attached, at one end, to the top of the pivotable display unit (16) and, at the other end, is secured either to an existing suspended ceiling (62) or to existing shelving (54).

2 Claims, 5 Drawing Sheets

FIG. 5
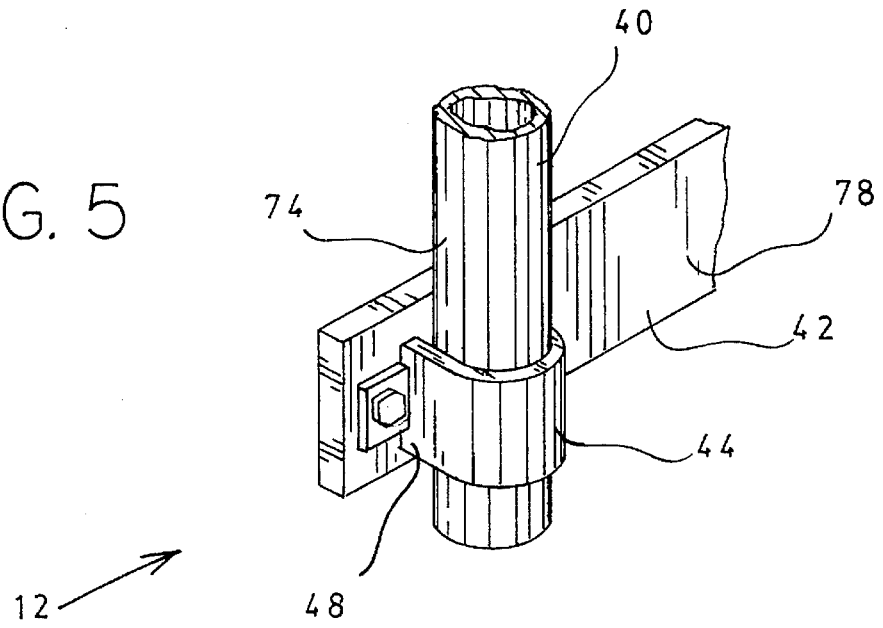
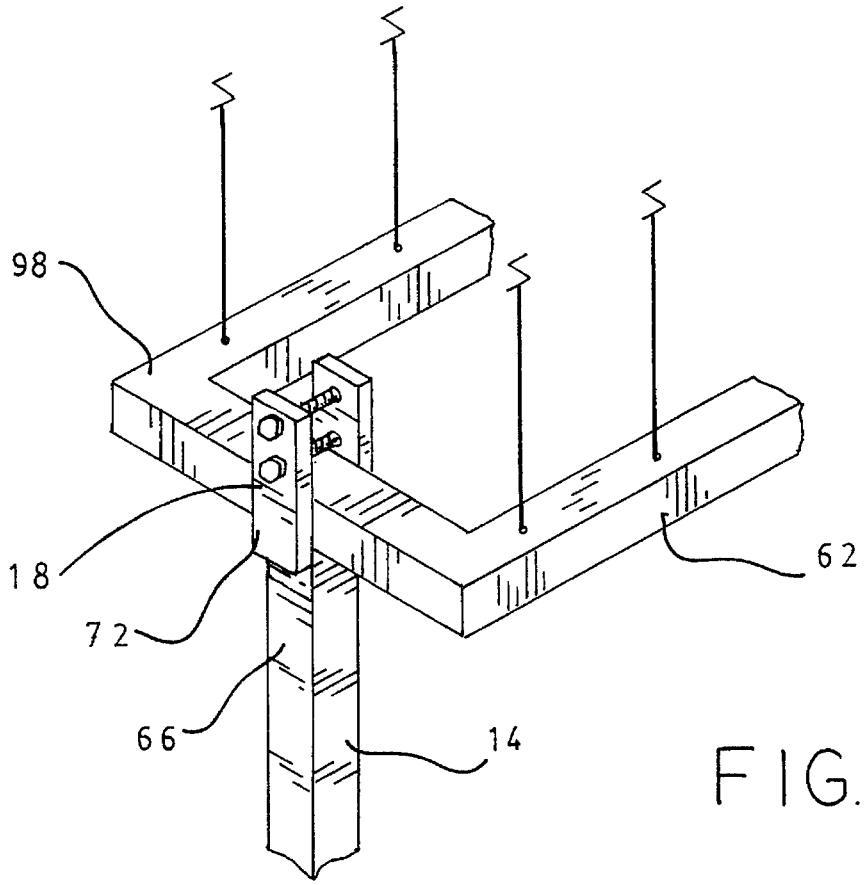
FIG. 6

DISPLAY RACK

This application is a Continuation-In-Part of Ser. No. 07/922,150, filed Jul. 30, 1992, now U.S. Pat. No. 5,242,054.

TECHNICAL FIELD

This invention relates to the field of display racks. More specifically, it relates to a device which will allow a pivotable display unit, such as those on which ceiling fan pulls, postcards, greeting cards, keychains, and comic books are displayed, to be used in conjunction with existing display facilities such as shelving or a suspended ceiling. This will allow a pivotable display unit to be used without taking up additional floor space.

BACKGROUND ART

The objective of mass merchandisers is to display as much product as possible in a given amount of floor space. This allows the merchandiser to carry a wide variety of merchandise. Mass merchandisers do this in the hope that the shopper will not have to go to any other store to fulfill any consumer needs.

It is well known that shelving is commonly used to display the merchandise. It is also well known that the shelving is typically positioned and dimensioned so as to maximize the amount of merchandise displayed in any given area of floor space while allowing shoppers to easily view the merchandise and still meet any local regulations such as fire codes.

Another common method of displaying merchandise is the use of the pivotable, stand-alone, floor display racks such as those on which ceiling fan pulls, postcards, greeting cards, keychains, and comic books are displayed. These racks typically stand alone and require extra floor space. Mass merchandisers may be prohibited from carrying merchandise which uses this type of display because of a lack of the required floor space. In addition, these racks usually have a base and/or legs which prohibit their use on existing shelving.

Another drawback is that these pivotable, stand-alone, floor display racks usually only stand 6 to 8 feet high which is lower than the height of most mass merchandisers' ceilings or existing shelving. Thus, these racks do not allow the greatest amount of merchandise possible to be displayed in the amount of floor space that such a rack takes up. As such, a mass merchandiser may refuse to carry a product if the manufacturer offers no alternate method of display to the pivotable, stand-alone, floor display rack.

Therefore, it is an object of this invention to provide a display rack capable of being used on existing display facilities such as shelving or a suspended ceiling.

It is an additional object of this invention that it be easily deployed and inexpensive.

DISCLOSURE OF THE INVENTION

Other objects and advantages will be accomplished by the present invention which serves to allow a pivotable display unit to be used with existing display facilities such as shelving or a suspended ceiling. In accordance with the various features of the invention, an improved display rack is provided. The invention comprises a pivotable display unit, a lower supporting member, and an upper stabilizing member. One end of the lower supporting member is attached to the bottom of the pivotable display unit such that it extends downward from the axis about which the pivotable display unit rotates. The other end of the lower supporting member is supported either by the floor, by the base of existing shelving, or by being attached to the existing shelving. This provides support for the improved display rack. One end of the upper stabilizing member is attached to the top of the pivotable display unit such that it extends upward from the axis about which the pivotable display unit rotates. The other end of the upper stabilizing member is secured to a beam of an existing suspended ceiling or to existing shelving. This provides stabilization for the improved display rack. Utilized in this way, the improved display rack provides a device which will allow a pivotable display unit to be used in stores in which merchandise may be displayed in conjunction with an existing ceiling or existing shelving.

BRIEF DESCRIPTION OF THE DRAWINGS

The above mentioned features of the invention will become more clearly understood from the following detailed description of the invention read together with the drawings in which:

FIG. 5 is a perspective view of a portion of the lower supporting member as formed by joining two distinct pieces with a U-shaped brace;

FIG. 6 is a perspective view of an alternate embodiment of the upper stabilizing member utilizing an upper adapting member which is a vise-like device;

BEST MODE FOR CARRYING OUT THE INVENTION

Figure 1:
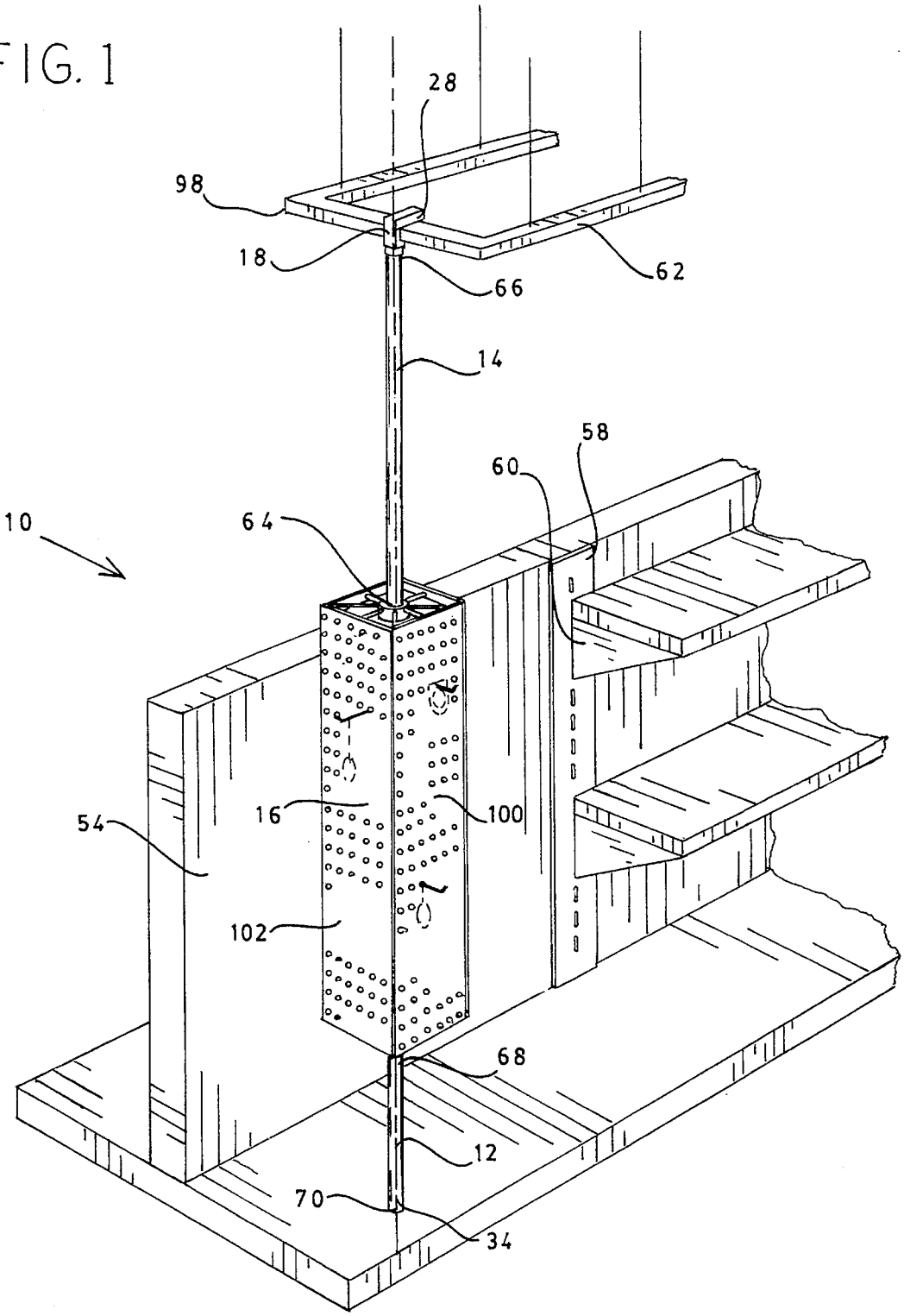
FIG. 1 is a perspective view of the improved display rack as used in conjunction with a suspended ceiling wherein the improved display rack is attached to a suspended ceiling in a selected fashion.

An improved display rack incorporating various features of the present invention is illustrated generally at 10 in the figures. The improved display rack 10 is designed to allow a pivotable display unit 16 which must normally stand alone in its own floor space, to be used with existing display facilities such as existing shelving 54 or an existing suspended ceiling 62. In this way, the improved display rack 10 will not require use of additional floor space. Moreover, the improved display rack 10 is inexpensive and easily deployed.

The improved display rack 10 comprises a pivotable display unit 16, an upper stabilizing member 14, and a lower supporting member 12. When the upper stabilizing member 14 or the lower supporting member 12 are customized for use with existing shelving 54 or an ,existing suspended ceiling 62, a lower adapting member 20, an upper adapting member 18, or both are incorporated to secure the improved display rack 10 to the customer's existing shelving 54 or existing suspended ceiling 62.

As shown in FIG. 1, the pivotable display unit 16 is substantially similar to a conventional display stand which pivots, to any extent, about a vertical axis 34. Examples include stands which are used to display ceiling fan pulls, postcards, greeting cards, keychains, or comic books. The pivotable display unit 16 comprises an exterior surface 100 upon which merchandise is displayed. The pivotable display unit 16 is secured to and pivots about a substantially vertical axis 34. The exterior surface 100 may define any selected configuration, such as cylindrical (not shown) or multi-faceted, shown being defined by a plurality of panels 102 with adjacent edges placed in close proximity with one another.

As shown in FIG. 1, in the first preferred embodiment of the lower supporting member 12, the lower supporting member 12 is substantially vertical and defines a first end 68 and a second end 70. The first end 68 of the substantially vertical lower supporting member 12 is secured proximate to the bottom of the pivotable display unit 16 such that the substantially vertical lower supporting member 12 extends in a downward direction and is coaxial with the vertical axis 34. The second end 70 of the substantially vertical lower supporting member 12 will be configured to engage a selected supporting surface such as a floor or the base of existing shelving 54.

In an alternate embodiment of the lower supporting member 12, however, the lower supporting member 12 may be integrally formed with the pivotable display unit 16.

Figure 2:
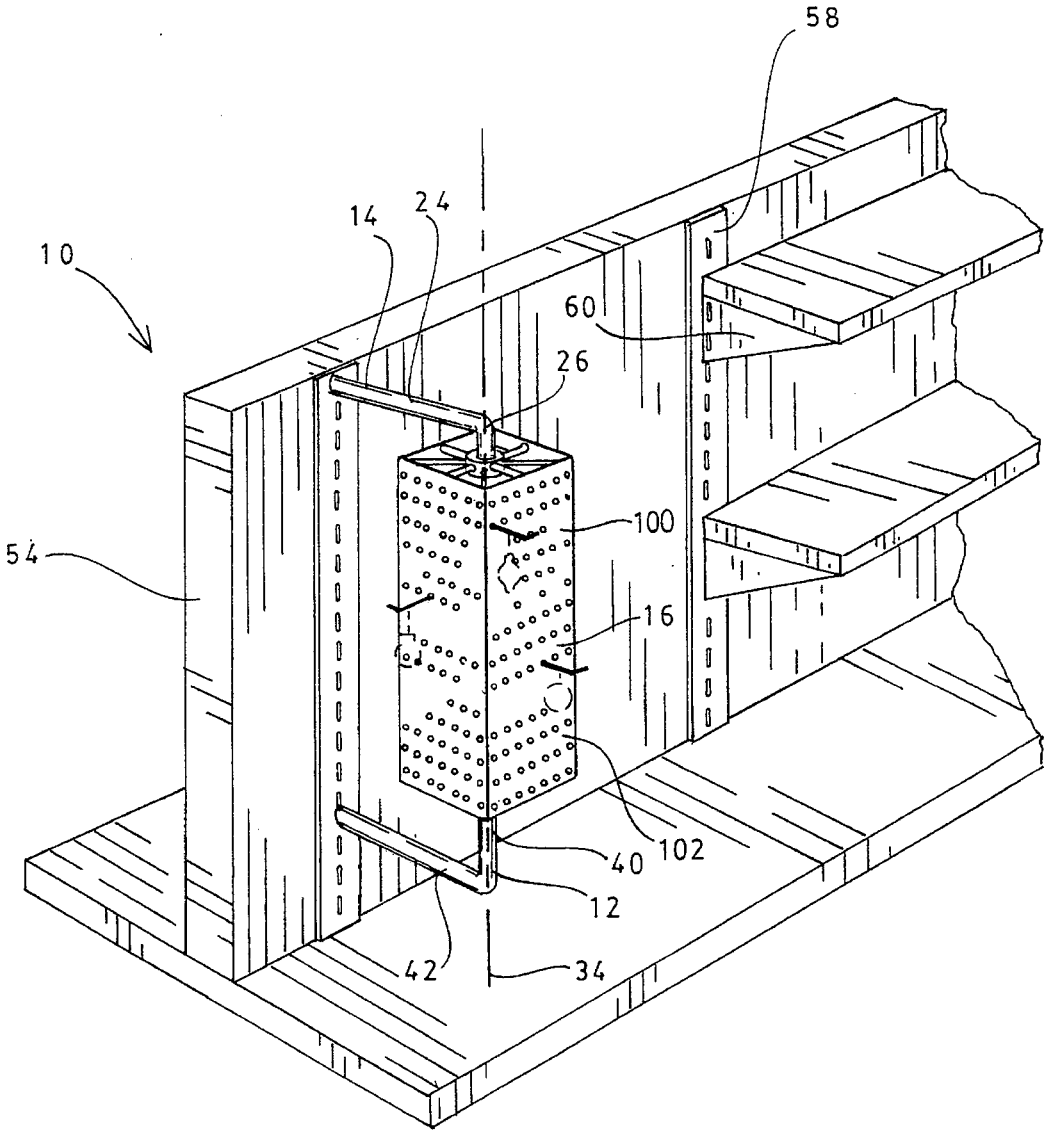
FIG. 2 is a perspective view of then improved display rack utilizing an inverted "L"-shaped upper stabilizing member and an "L"-shaped lower supporting member, to be received by slots on slotted bracket holders of existing shelving.

FIGS. 2 illustrates a second preferred embodiment of the lower supporting member 12 as substantially "L"-shaped. In this embodiment, the lower supporting member 12 defines a substantially vertical portion, or the lower vertical portion 40, defining a first end 74 and a second end 76, and a substantially horizontal portion, or the lower horizontal portion 42, defining a first end 78 and a second end 80. The lower vertical portion 40 and the lower horizontal portion 42 may be integrally formed, as in FIG. 2.

Figure 3:
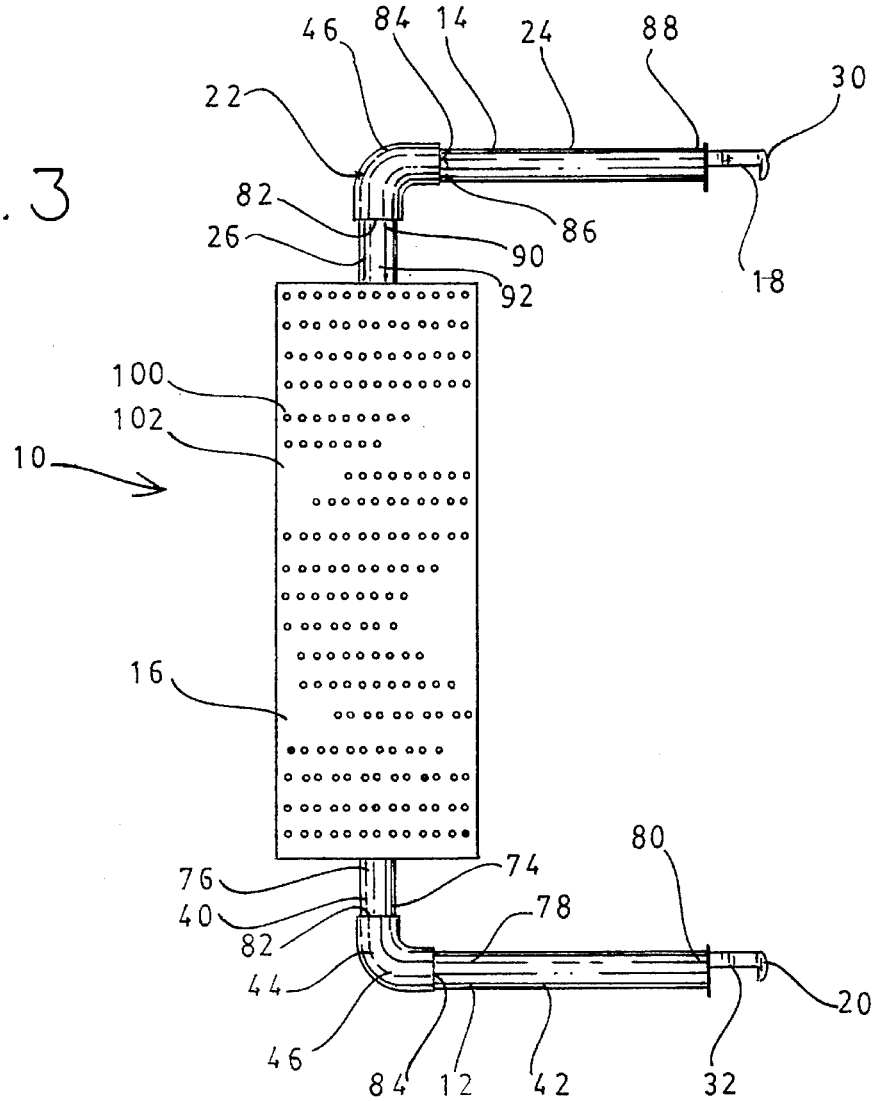
FIG. 3 is a right side elevational view of the improved display rack of FIG. 2.

However, in an alternate embodiment of the lower supporting member 12, shown in FIG. 3, the lower horizontal portion 42 and the lower vertical portion 40 may define two separate members which may be selectively secured one to another in a conventional fashion. In this embodiment of the lower supporting member 12, a lower coupler 44 may be used to secure the lower horizontal portion 42 to the lower vertical portion 40.

The lower coupler 44 is configured to closely receive the lower vertical portion 40 and to be received by or secured to the lower horizontal portion 42. As in FIG. 3, the lower coupler 44 may define an elbow member 46, defining a substantially "L"-shaped configuration, defining a first opening 82 and a second opening 84, formed so that the first end 74 of the lower vertical portion 40 may be closely received by the first opening 82 of the elbow member 46 and the first end 78 of the lower horizontal portion 42 may be closely received by the second opening 84 of the elbow member 46. When connected in such a way, the elbow member 46, the lower horizontal portion 42, and the lower vertical portion 40 form a substantially "L"-shaped lower supporting member 12.

The lower coupler 44 may alternately be a clamp-like or vise-like device or may define a member which is molded around the juncture of the lower vertical portion 40 and the lower horizontal portion 42.

It will be understood that other conventional securement devices may be used to secure the lower vertical portion 40 to the lower horizontal portion 42.

Figure 4:
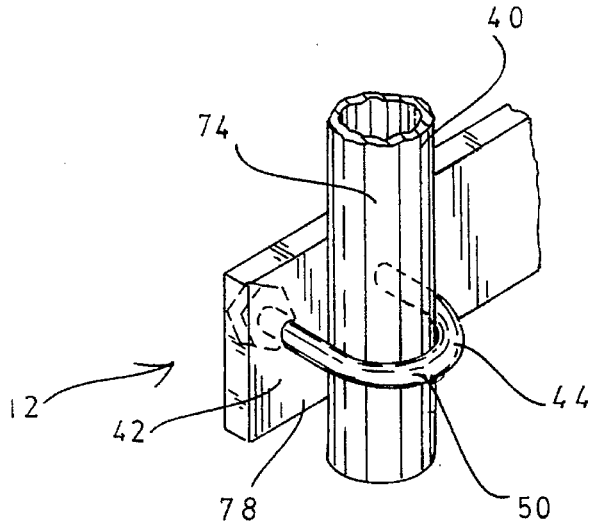
FIG. 4 is a perspective view of a portion of the lower supporting member as formed by joining two distinct pieces with a U-bolt.

Alternatively, the lower coupler 44 may be a U-bolt 50, as shown in FIG. 4, or a "U"-shaped brace 48, as shown in FIG. 5.

In an alternate embodiment of the improved display rack 10, the second end 80 of the lower horizontal portion 42 of the substantially "L"-shaped lower supporting member 12 includes a lower adapting member 20, as shown in FIG. 3, for securing the lower horizontal portion 42 to existing shelf support brackets. In this embodiment, the lower adapting member 20 comprises a lower bracket attachment member 32, as shown in FIG. 3, defining a configuration substantially similar to the attachment portion of a shelf support bracket 60 which fits into the slotted bracket holder 58.

However, the lower adapting member 20 could also be a clamp-like device, a vise-like device, or any other conventional device which would secure the lower supporting member 12.

The first end 68 of the lower supporting member 12 is secured proximate to the bottom of the pivotable display unit 16 so as to extend in a downward direction and coaxial with the vertical axis 34 about which the pivotable display unit 16 pivots. If the first preferred embodiment of the lower supporting member 12 is used, as in FIG. 1, the second end 70 of the lower supporting member 12 rests on the floor or on the existing shelving 54.

However, if the second preferred embodiment of the lower supporting member 12, shown in FIGS. 2 and 3, is used, the lower adapting member 20 will be secured to whatever supporting surface is desired, such as the existing shelving 54, as described above. For instance, if the lower adapting member 20 is lower bracket attachment member 32, the lower bracket attachment member 32 is received within a slot defined by the slotted bracket holder 58 in a manner substantially similar to a shelf support bracket 60.

In the first preferred embodiment of the upper stabilizing member 14, shown in FIG. 1, the upper stabilizing member 14 comprises a substantially vertical member, defining a first end 64 and a second end 66, and an upper adapting member 18. The upper adapting member 18 may be formed integrally with the second end 66 of the upper stabilizing member 14 Alternately, the upper adapting member 18 may be selectively secured proximate to the second end 66 of the upper stabilizing member 14 in a conventional manner.

In the second preferred embodiment, the upper stabilizing member 14 defines a substantially inverted "L"-shaped configuration, as shown in FIGS. 2 and 3. In this embodiment, the upper stabilizing member 14 comprises a horizontal portion, or the upper horizontal portion 24, defining a first end 86 and a second end 88, and a vertical portion, or the upper vertical portion 26, defining a first 90 end and a second end 92. The first end 86 of the upper horizontal portion 24 is attached to the first end 90 of the upper vertical portion 26. The second end 88 of the upper horizontal portion 24 is attached to the existing suspended ceiling 62 or existing shelving 54.

In the second preferred embodiment, the upper stabilizing member 14 may be integrally formed, as in FIG. 2, by joining the upper horizontal portion 24 and the upper vertical portion 26.

In an alternate embodiment of the second preferred embodiment of the upper stabilizing member 14, an upper coupler 22 may be used to secure the upper horizontal portion 24 to the upper vertical portion 26, as in FIG. 3. The upper coupler 22 is substantially similar to the lower coupler 44, as described above.

An alternate embodiment of the upper coupler 22 as an elbow member 46 is shown in FIG. 3.

Figure 8:
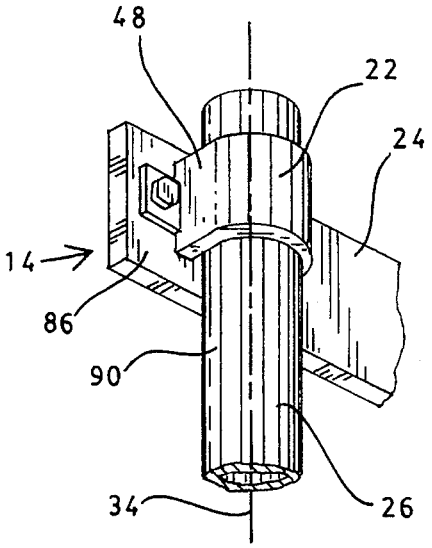
FIG. 8 is a perspective view of a potion of the upper stabilizing member as formed by joining two distinct pieces with a "U"-shaped brace.

An alternate embodiment of the upper coupler 22 as a "U"-shaped brace 48 is shown in FIG. 8.

Figure 9:
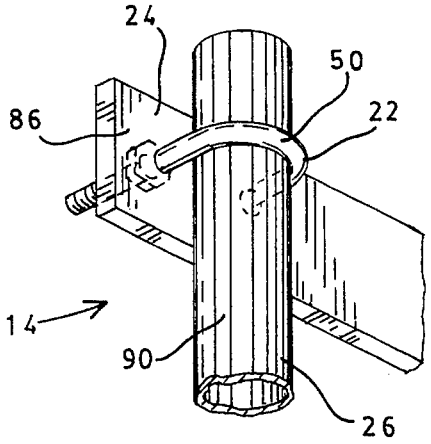
FIG. 9 is a perspective view of a portion of the upper stabilizing member as formed by joining two distinct pieces with a U-bolt.

An alternate embodiment of the upper coupler 22 as a U-bolt 50 is shown in FIG. 9.

The upper coupler 22, although not shown, may alternatively be a clamp-like device, vise-like device, or any other device which would serve to secure the upper horizontal portion 24 to the upper vertical portion 26.

In yet another alternate embodiment, although not shown, the upper coupler 22 may instead be molded around the juncture of the upper horizontal portion 24 and the upper vertical portion 26. However, the upper horizontal portion 24 may be secured to the upper vertical portion 26 by any means.

In any preferred embodiment of the upper stabilizing member 14, the second end 88 of the upper horizontal portion 24 includes an upper adapting member 18. In one embodiment, shown in FIG. 3, the upper adapting member 18 comprises an upper bracket attachment member 30 defining a configuration substantially similar to the lower bracket attachment member 32 as described above.

In another embodiment, the upper adapting member 18 may be a vise-like device 72 as shown in FIG. 6.

Figure 7:
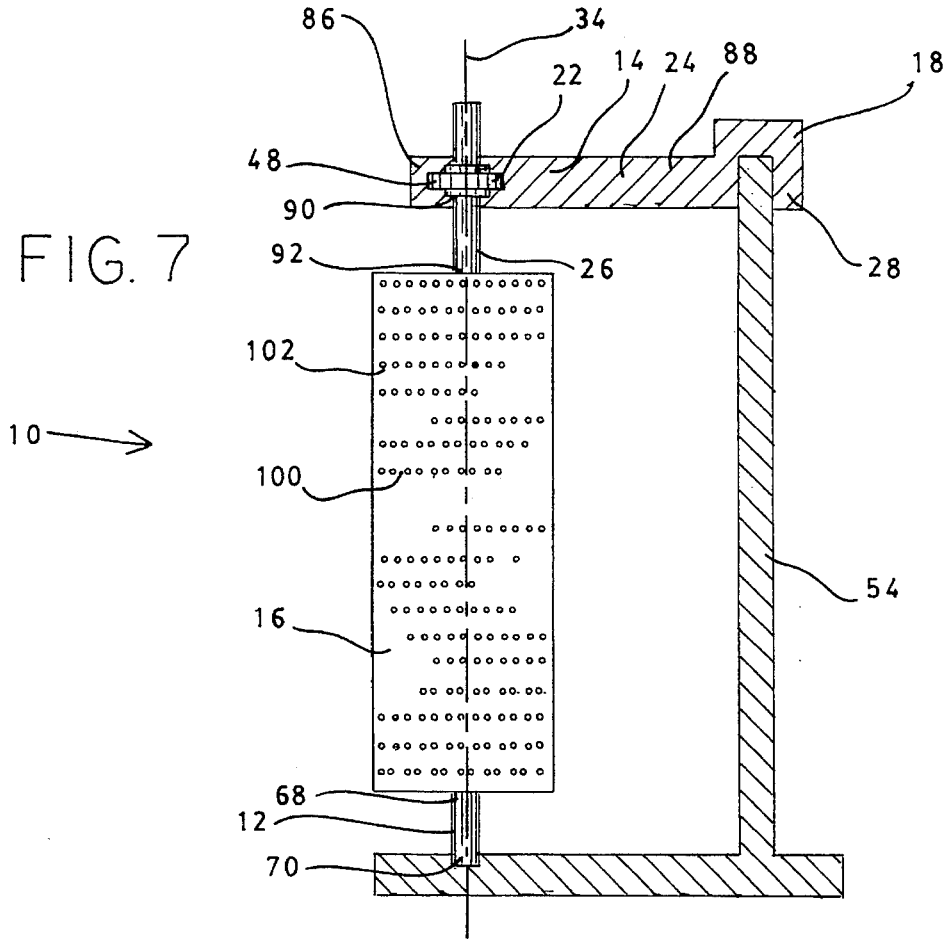
FIG. 7 is a right side elevational view of the improved display rack wherein the upper stabilizing member is secured to the top of existing shelving by a hook.

However, in an alternate embodiment, if the upper stabilizing member 14 is to be attached over the top of existing shelving 54, the upper adapting member 18 may be substantially shaped like a hook 28. In this way, the upper stabilizing member 14 would provide stability to the improved display rack 10 by using the existing shelving 54 as illustrated in FIG. 7.

Although not shown, the upper adapting member 18 could also obviously be a clamp-like device.

The first end 64 of the upper stabilizing member 14 will be attached proximate to the top of the pivotable display unit 16 in such a way as to extend in an upward direction and coaxial with the vertical axis 34. The upper adapting member 18 of any embodiment then engages a beam 98 of the existing suspended ceiling 62, the existing shelving 54, or whatever the users wishes. The improved display rack 10 will be secured such that the pivoting of the pivotable display rack 16 is unencumbered. In this way, a stand alone display rack, which usually needs previously unoccupied floor space for its use, can be used on existing shelving 54 or with an existing suspended ceiling 62.

From the foregoing description, it will be recognized by those skilled in the art that an improved display rack 10 offering advantages over the prior art has been provided. Specifically, the improved display rack 10 provides an easily-deployable and inexpensive device for using a pivotable display unit 16 on existing shelving 54 or with an existing suspended ceiling 62, so as not to occupy any previously unused floor space.

While two preferred embodiments have been described and shown, it will be understood that these are not intended to limit the disclosure, but rather are intended to cover all modifications and alternate methods falling within the spirit and the scope of the invention as defined in the appended claims. For instance, any selected embodiment of a lower supporting member 12, whether a substantially vertical piece, an integrally formed, "L"-shaped piece, or an "L"-shaped piece made of two or more distinct pieces, may be used with any selected embodiment of the upper stabilizing member 14, whether a substantially vertical piece, an integrally formed, inverted-"L"-shaped piece, or an inverted-"L"-shaped piece made of two or more distinct pieces. In addition, any type of lower adapting member 20 or upper adapting member 18 may be used with any combination of the above.

Having thus described the aforementioned invention, I claim:

1. An improved display rack for use in conjunction with existing facilities which include an existing suspended ceiling, and existing shelving resting on a floor, said improved display rack comprising:

a pivotable display unit defining a surface on which selected merchandise is displayed, said pivotable display unit being rotatable about a substantially vertical axis;

an upper stabilizing member defining a first end and a second end, said first end being secured to a top of said pivotable display unit, said second end carrying an adapting member for engaging a beam of the suspended ceiling, said adapting member being configured such that said adapting member is movable along the beam whereby said improved display rack is repositionable;

a lower supporting member defining a first end and a second end, said first end being secured to a base of said pivotable display unit, said second end being configured to be supported by the existing facilities.

2. The improved display rack of claim 1 wherein said lower supporting member defines a substantially "L" shape configuration, said second end of said lower supporting member defining an adaptor hook configured to be received by the existing shelving unit.

* * * * *